US008113683B1

(12) United States Patent
Ehresman et al.

(10) Patent No.: US 8,113,683 B1
(45) Date of Patent: Feb. 14, 2012

(54) HID LUMINAIRE WITH THERMALLY ISOLATED LAMP AND BALLAST COMPARTMENTS

(75) Inventors: Adrian Thomas Ehresman, Aurora, CO (US); Jeffrey Brian Nepple, Evergreen, CO (US)

(73) Assignee: Cooper Technologies Company, Houston, TX (US)

( * ) Notice: Subject to any disclaimer, the term of this patent is extended or adjusted under 35 U.S.C. 154(b) by 92 days.

(21) Appl. No.: 12/777,651

(22) Filed: May 11, 2010

(51) Int. Cl.
*F21S 8/06* (2006.01)

(52) U.S. Cl. ..... 362/218; 362/221; 362/217.02; 362/260; 362/263; 362/265

(58) Field of Classification Search ..... 362/218, 362/221, 217.02, 260, 261, 263–265
See application file for complete search history.

(56) References Cited

U.S. PATENT DOCUMENTS 4,268,894 A * 5/1981 Bartunek et al. ..... 362/158
5,597,233 A 1/1997 Lau
6,565,234 B1 5/2003 Skegin et al.
7,430,120 B2 9/2008 Lau
7,506,994 B1 3/2009 Waycaster et al.
7,513,646 B2 4/2009 Catone et al.
7,597,458 B2 * 10/2009 Johnson et al. ..... 362/265
7,604,366 B1 * 10/2009 Chen ..... 362/99
7,621,656 B2 * 11/2009 Tyson ..... 362/260
7,775,676 B2 * 8/2010 Yang ..... 362/221
2010/0002452 A1 1/2010 Gananathan

* cited by examiner

*Primary Examiner* — Anabel Ton
(74) *Attorney, Agent, or Firm* — King & Spalding LLP

(57) ABSTRACT

An HID luminaire includes a single luminaire housing that includes thermally isolated lamp and ballast compartments. At least one HID lamp is disposed within the luminaire housing, and at least one ballast is disposed within the ballast compartment. The lamp and ballast compartments are separated by a chamber that includes a substantially nonconductive member, which prevents heat from the lamp compartment from travelling to the ballast compartment. Thermally isolating the ballast from at least a portion of the heat generated by the HID lamp allows the ballast to be disposed relatively close to the HID lamp without becoming overheated and damaged. A hollow, threaded rod extends between and couples together the lamp compartment and ballast compartment. Electric wires connecting the HID lamp and ballast extends through the threaded rod, providing necessary electrical power in an aesthetically pleasing design.

20 Claims, 3 Drawing Sheets

HID LUMINAIRE WITH THERMALLY ISOLATED LAMP AND BALLAST COMPARTMENTS

TECHNICAL FIELD

The present disclosure relates generally to light fixtures, and more specifically to an HID luminaire that includes thermally isolated lamp and ballast compartments.

BACKGROUND

A luminaire is a system for producing, controlling, and/or distributing light for illumination. For example, a luminaire can include a system that outputs or distributes light into an environment, thereby allowing certain items in that environment to be visible. Luminaires are often referred to as "light fixtures."

An HID luminaire includes at least one high intensity discharge ("HID") lamp. The HID lamp is connected to at least one ballast that controls the current flowing through the HID lamp. By controlling the current flow, the ballast can be used to control the brightness of the HID lamp.

As a byproduct of converting electricity into light, an HID lamp typically generates a substantial amount of heat. If allowed to accumulate, the heat generated by the HID lamp can cause damage to the ballast. For example, raising the operating temperature of the ballast can result in efficiency degradation and premature failure of the ballast, thereby decreasing the lifespan and functionality of the HID luminaire.

Traditionally, HID luminaire manufacturers have addressed this problem by placing the HID lamp and ballast in different housings that are located far apart from one another. This configuration is expensive at least because a substantial amount of wiring is required to electrically connect the HID lamp housing with the ballast housing and because installation and maintenance of the HID luminaire requires a person to access and manipulate two different housings. This configuration also is generally undesirable because the external wiring and connections between the remote housings are not aesthetically pleasing.

SUMMARY

The invention provides a luminaire, which includes a cost-effective, aesthetically pleasing configuration that prevents heat output from the lamp from damaging a ballast of the luminaire. In particular, the invention provides a luminaire, which can include, in one device that looks like a single luminaire housing, thermally isolated lamp and ballast compartments. At least one lamp can be disposed within the luminaire housing, and at least one ballast can be disposed within the ballast compartment. The lamp and ballast compartments can be separated by a chamber that includes a substantially nonconductive member, which can prevent heat from the lamp compartment from travelling to the ballast compartment. This configuration thermally isolates the ballast from at least a portion of the heat generated by the lamp, allowing the ballast to be disposed relatively close to the lamp without becoming overheated. Although the luminaire is generally described herein as an HID luminaire, a person of ordinary skill in the art having the benefit of the present disclosure will recognize that the luminaire can include any type of lamp, such as a fluorescent, compact fluorescent, light emitting diode (LED), or incandescent lamp.

In one aspect, the luminaire can include a lamp housing that includes a first elongated member configured to house a lamp. The first elongated member can include opposing first and second ends. The first end of the first elongated member can define an opening through which light from the lamp is emitted. The second end of the first elongated member can include a first removable cap to which a socket is mounted. The socket is configured to receive the lamp. For example, a person can remove the cap to install, replace, remove, manipulate, or otherwise access the lamp.

The luminaire also includes a ballast compartment, which can include a second elongated member that is configured to house a ballast, which is configured to control the lamp. The second elongated member can include opposing first and second ends. The first end of the first elongated member and the second end of the second elongated member can define opposite ends of the luminaire. The second end of the second elongated member can comprise a second removable cap, which is positionable by a person to install, replace, remove, manipulate, or otherwise access the ballast.

A substantially nonconductive member can be disposed substantially between the lamp compartment and the ballast compartment. The substantially nonconductive member can engage the second end of the first elongated member and the first end of the second elongated member. Because it is substantially nonconductive, the substantially nonconductive member can prevent heat from the lamp from travelling from the first elongated member to the second elongated member.

A substantially hollow member can extend through the substantially nonconductive member, the second end of the first elongated member, and the first end of the second elongated member, thereby coupling together the first elongated member, the substantially nonconductive member, and the second elongated member. The substantially hollow member alone can couple these components together. Alternatively, a combination of the substantially hollow member and other components of the luminaire can couple together the first elongated member, the substantially nonconductive member, and the second elongated member. The substantially hollow member can be configured to house at least a portion of at least one electric wire, which electrically couples the lamp to the ballast.

These and other aspects, features, and embodiments of the invention will become apparent to a person of ordinary skill in the art upon consideration of the following detailed description of illustrated embodiments exemplifying the best mode for carrying out the invention as presently perceived.

BRIEF DESCRIPTION OF THE DRAWINGS

For a more complete understanding of the present invention and the advantages thereof, reference is now made to the following description, in conjunction with the accompanying figures briefly described as follows.

DETAILED DESCRIPTION OF EXEMPLARY EMBODIMENTS

The following description of exemplary embodiments refers to the attached drawings, in which like numerals indicate like elements throughout the several figures.

Figure 1:
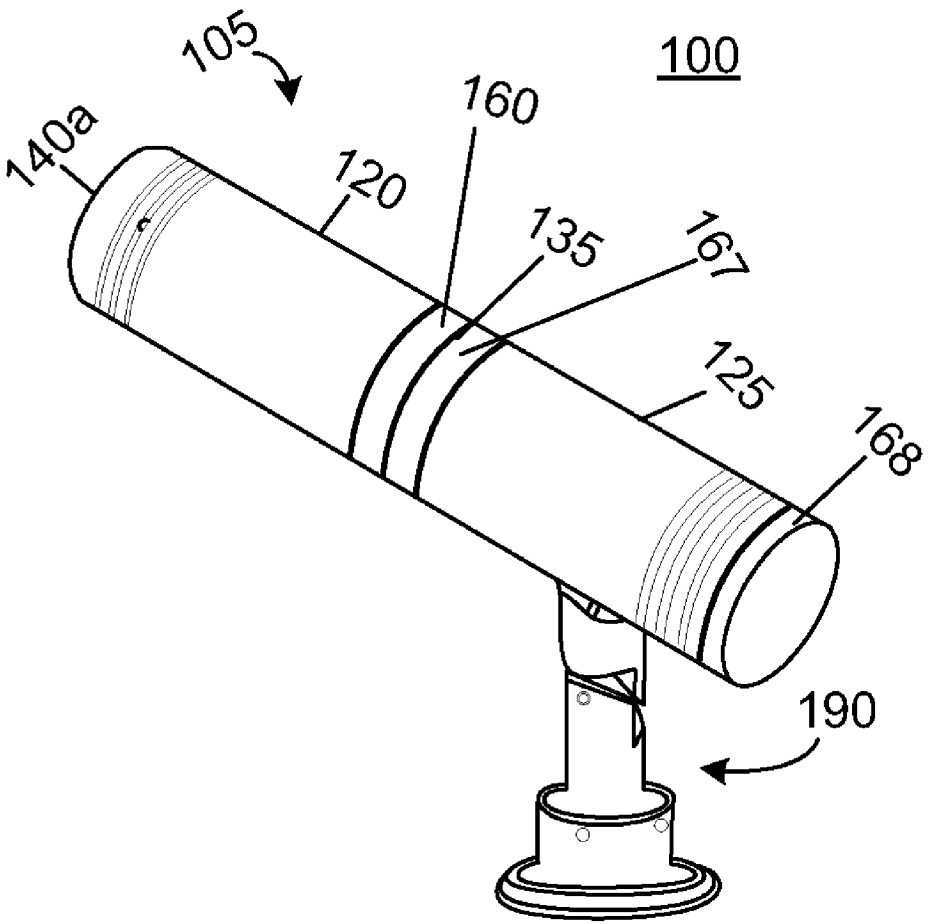
FIG. 1 is an isometric view an HID luminaire, in accordance with certain exemplary embodiments.
Figure 2:
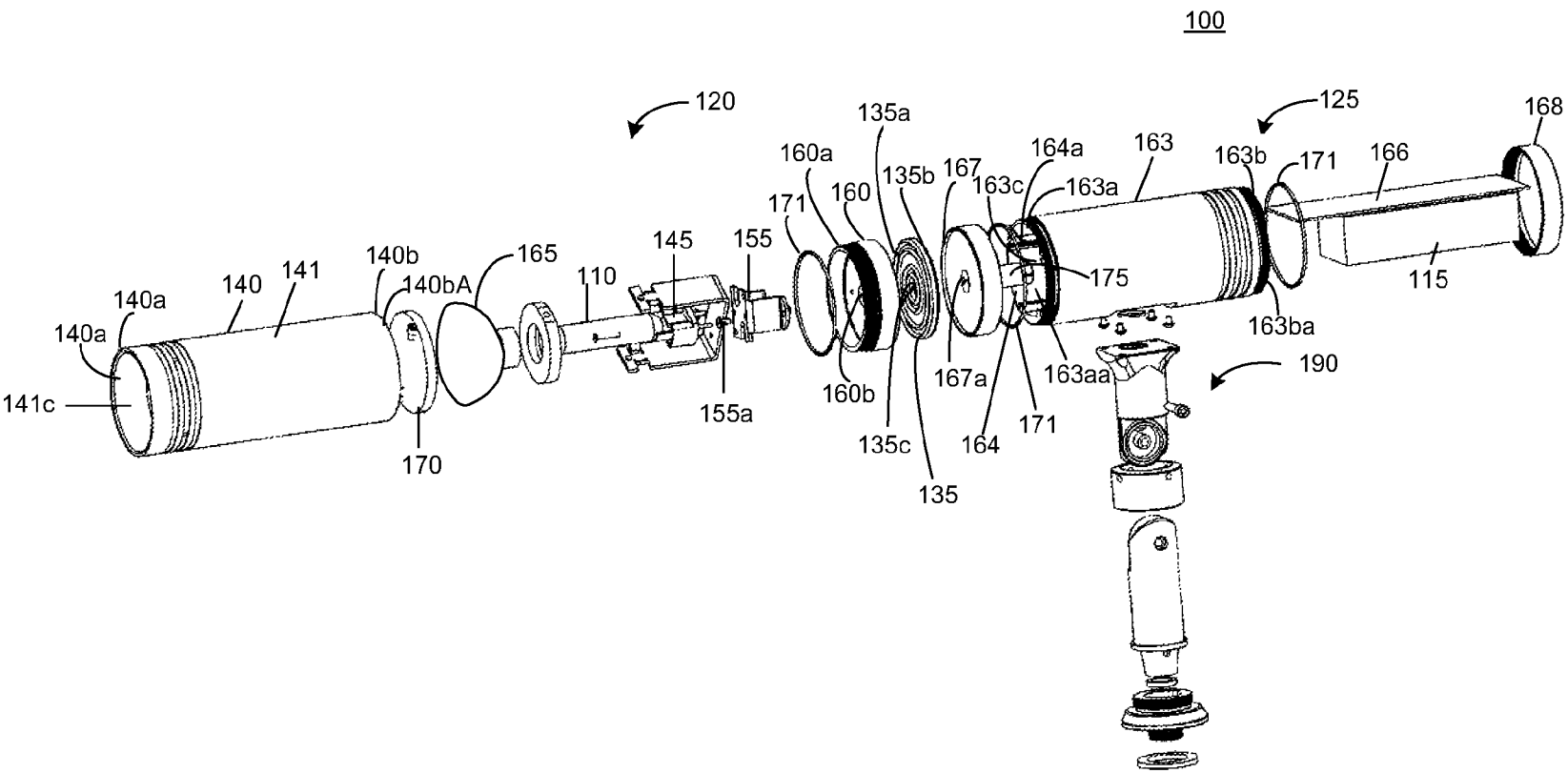
FIG. 2 is an exploded view of the HID luminaire of FIG. 1, in accordance with certain exemplary embodiments.
Figure 3:
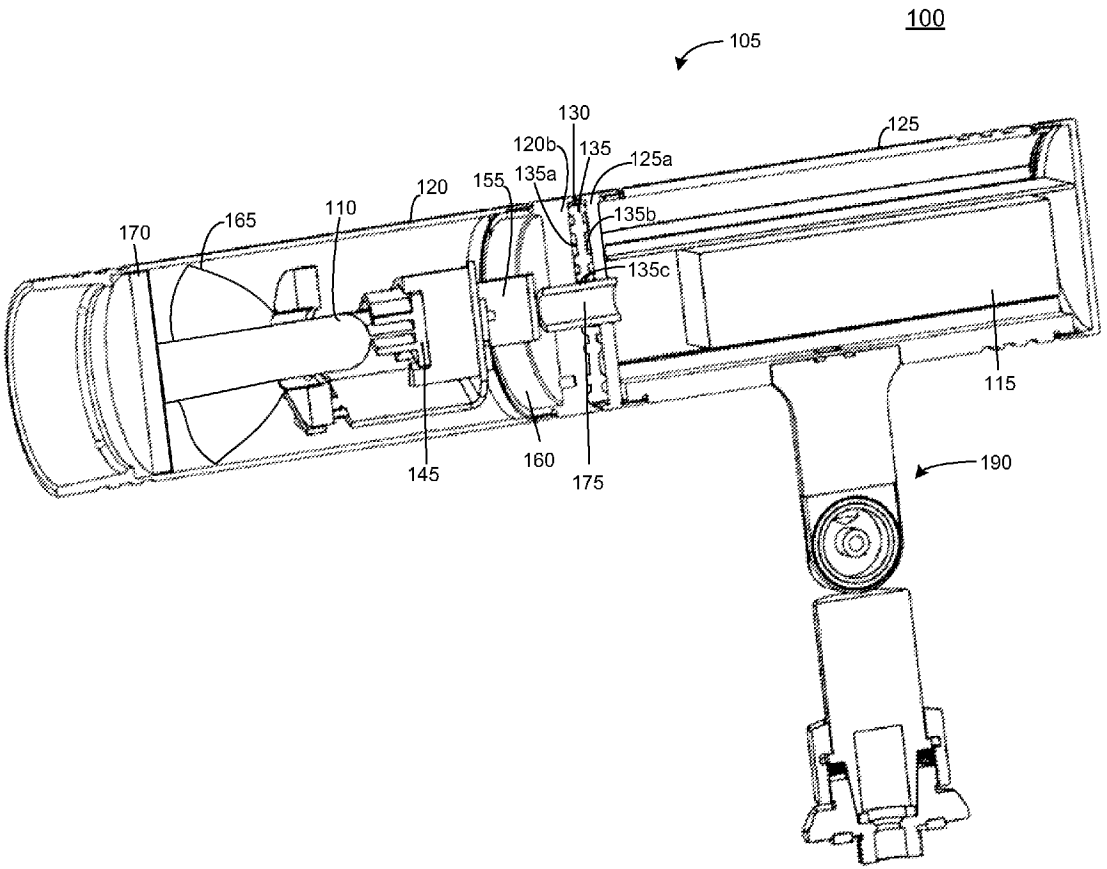
FIG. 3 is a cross-sectional view of the HID luminaire of FIG. 1, in accordance with certain exemplary embodiments.

FIGS. 1-3 illustrate an HID luminaire 100 in accordance with certain exemplary embodiments. The HID luminaire 100 includes a single luminaire housing 105, which contains both an HID lamp 110 and a ballast 115 that controls the HID lamp 110. More specifically, the luminaire housing 105 includes a lamp compartment 120 that houses the HID lamp 110 and a ballast compartment 125 that houses the ballast 115. The lamp compartment 120 and ballast compartment 125 are separated by a chamber 130 that includes a substantially nonconductive member 135, which prevents heat from the lamp compartment 120 from travelling to and damaging the ballast 115, as described below.

As best seen in FIG. 2, the exemplary lamp compartment 120 includes a substantially cylindrical housing 140 having opposing ends 140*a* and 140*b* that include openings 140*aa* and 140*ba*, respectively. The housing 140 includes a member 141 that defines a channel 140*c* that connects the openings 140*aa* and 140*ba*. The HID lamp 110 is disposed within the channel 140*c*. Light generated by the HID lamp 110 is output through the opening 140*aa*. While the exemplary embodiment describes the housing 140 as being cylindrical, other geometric and non-geometric shapes including, but not limited to, square and rectangular are contemplated and within the scope and spirit of this disclosure.

The HID lamp 110 is a lamp that generates light using an electric arc or "discharge" between two electrodes (not shown) in the lamp 110. When the HID lamp 110 is installed in the HID luminaire 100, the electrodes are components of an electrical circuit, which includes the ballast 115. When the ballast 115 energizes the electrical circuit, an electric arc forms between the electrodes and ionizes gas and metallic vapor, such as mercury, metal halide, or high-pressure sodium, within the HID lamp 110. This ionization causes an electric arc to strike between the two electrodes. That arc radiates intense light. Although an HID lamp 110 can be used in substantially any lighting application, its intense light output makes it particularly suited for outdoor lightning applications and large indoor arena environments. For example, the luminaire 100 may include any of a variety of structures 190 for mounting the luminaire to a wall or other surface in the environment, as would be readily understood by a person of ordinary skill in the art having the benefit of the present disclosure.

In certain exemplary embodiments, the luminaire 100 includes a reflector 165 and/or a cover 170 disposed in the housing 140, substantially between the HID lamp 110 and the opening 140*aa*. The exemplary reflector 165 depicted in FIGS. 1-3 includes a substantially frusto-conical shaped member comprised of a material that reflects, refracts, transmits, or diffuses light emitted by the HID lamp 110. The exemplary cover 170 depicted in FIGS. 1-3 includes a substantially cylindrical, optically transmissive member that provides protection to the HID lamp 170 from dirt, dust, moisture, and any other environmental contaminants. In certain exemplary embodiments, the cover 170 is configured to control light from the HID lamp 110 via refraction, diffusion, baffles, louvers, or the like. For example, the cover 170 is capable of including a refractor, a lens, an optic, or a milky plastic or glass element.

A person of ordinary skill in the art having the benefit of the present disclosure will recognize that the shape and material of the reflector 165 and the cover 170 can vary depending on a variety of factors, including the size and shape of the HID lamp 110, the size and shape of the opening 140*aa*, the size and shape of the housing 105 or the individual compartments 120, 125, and the desired photometric distribution of the light. Depending on the desired lighting application, the luminaire 100 may not include a reflector 165 or a cover 170 in certain alternative exemplary embodiments.

The HID lamp 110 is electrically coupled to a socket 145, which is in turn electrically coupled to the ballast 115. The socket 145 is mounted within the housing 140 via a bracket 155 coupled to a cap 160, which is removably coupled to the end 140*b* of the housing 140. In the exemplary embodiment depicted in FIGS. 1-3, the cap 160 is removably coupled to the end 140*b* of the housing 140 via interlocking threads 160*a* on or in the cap 160 and end 140*b*, and the bracket 155 is coupled to the cap 160 via one or more screws 155*a*. A person of ordinary skill in the art having the benefit of the present disclosure will recognize that any other fastening means, such as one or more screws, nails, snaps, clips, collars, and/or pins, may be used to removably couple the cap 160 to the end 140*b* and/or to couple the bracket 155 to the cap 160 in certain alternative exemplary embodiments.

The ballast 115 is disposed within the ballast compartment 125. The ballast compartment 125 includes a substantially cylindrical housing 163 having opposing ends 163*a* and 163*b* that include openings 163*aa* and 163*ba*, respectively. While the exemplary embodiment describes the ballast compartment 125 as being cylindrical, other geometric and non-geometric shapes, including, but not limited to, square and rectangular are contemplated and within the scope and spirit of this disclosure. The housing 163 includes a member 164 that defines a channel 163*c* that connects the openings 163*aa* and 163*ba*. In the exemplary embodiment depicted in FIGS. 1-3, the ballast 115 is removably mounted to an interior surface of the member 164, within the channel 163*c*, via a tab 166. The tab 166 is attached to, or integral with, the ballast 115 and is slidable within one or more slots 164*a* on the interior surface of the member 164. A person of ordinary skill in the art having the benefit of the present disclosure will recognize that any other fastening means, such as one or more screws, nails, snaps, clips, collars, and/or pins, may be used to removably mount the ballast 115 to the member 164 in alternative exemplary embodiments.

Ends 163*a* and 163*b* are removably coupled to caps 167 and 168, respectively. The caps 167 and 168 are selectively positionable to open and close the ballast compartment 125. For example, a person can remove cap 168 to access and service the ballast 115. In the exemplary embodiment depicted in FIGS. 1-3, the caps 167 and 168 are removably coupled to their respective ends 163*a* and 163*b* via interlocking threads on or in the caps 167 and 168 and ends 163*a* and 163*b*. A person of ordinary skill in the art having the benefit of the present disclosure will recognize that any other fastening means, such as one or more screws, nails, snaps, clips, collars, and/or pins, may be used to removably couple each cap 167, 168 to its respective end 163*a*, 163*b*. In certain exemplary embodiments, each of the caps 160, 167, and 168 is capable of being separated from its respective housing end 140*b*, 163*a*, 163*b* via an o-ring 171 or other gasket member, which helps seal the ends 140*b*, 163*a*, and 163*b* when the caps 160, 167, and 168, respectively, are installed.

The socket 145 is electrically coupled to the ballast 115 via one or more electrical wires (not shown) that extend between the socket 145 and ballast 115, through a threaded rod 175 commonly referred to as an "all-thread." The rod 175 includes a substantially hollow, cylindrical member that defines a channel through which the wires extend. A person of ordinary skill in the art having the benefit of the present disclosure will recognize that the shape and size of the rod 175 can vary depending on a variety of factors, including the size and shape of each housing 140, 163 and/or the wires extending therebetween. While the exemplary embodiment describes the rod 175 as being a substantially cylindrical member, other geometric and non-geometric shapes, including, but not limited to, square, rectangular, and oval are contemplated and within the scope and spirit of this disclosure. The rod 175 extends through openings 160*b* and 167*a* in the cap 160 of the lamp compartment 120 and the cap 167 of the ballast compartment 125, respectively. Threads (not shown) on the rod 175 engage interior surfaces of the caps 160 and 167, thereby securing the rod 175 to the caps 160 and 167.

Thus, the rod 175 extends through and couples together an end 120*b* of the lamp compartment 120 opposite the opening 140*a* and an end 125*a* of the ballast compartment 125 that is adjacent the end 120*b*. In the exemplary embodiment depicted in FIGS. 1-3, the rod 175 alone couples together the lamp compartment 120 and the ballast compartment 125, thereby providing structural stability for the HID luminaire 100 at the junction between the lamp compartment 120 and the ballast compartment 125. In certain alternative exemplary embodiments, multiple rods 175 or other fastening means in addition to or in place of the rod 175 are used to couple the lamp compartment 120 and ballast compartment 125 together.

As a byproduct of converting electricity into light, the HID lamp 110 generates a substantial amount of heat. The housings 140 and 163 and rod 175 are each comprised of a material that can withstand such heat without degrading. For example, each of the housings 140 and 163 and the rod 175 may comprise a metal, such as aluminum or stainless or heat resistant steel, in certain exemplary embodiments. The housings 140 and 163 and rod 175 may comprise the same material or different materials.

In the exemplary embodiment depicted in FIGS. 1-3, the housings 140 and 163 are separated by the chamber 130 such that the ends 120*b* and 125*a* of the lamp compartment 120 and ballast compartment 125, respectively, do not engage, or contact, one another. At least a portion of the substantially cylindrical member 135 is disposed within the chamber 130. The member 135 is essentially sandwiched between the ends 120*b* and 125*a*, with a first side 135*a* of the member 135 engaging or at least disposed proximate the end 120*b* and a second side 135*b* of the member 135 engaging or at least disposed proximate the end 125*a*. The rod 175 extends substantially through each of the opening 160*b*, a channel 135*c* that extends through the member 135, and the opening 167*a*, thereby mounting the member 135 between the ends 120*b* and 125*a*.

The member 135 comprises a non-conductive or substantially non-conductive material, such as a non-conductive plastic. The member 135 essentially acts as a thermal barrier between the compartments 120 and 125, preventing heat from the HID lamp 110 from travelling from the lamp compartment 120 to the ballast compartment 125. Instead of travelling to the ballast compartment 125, substantially all or nearly all of the heat is collected within the lamp compartment 120 and convected out of the lamp compartment 120 via the housing 140 and cap 160. For example, certain of the heat is (a) convected from the HID lamp 110 to an interior surface of the member 143 or the cap 160, (b) conducted from the interior surface of the member 143 or cap 160 to an exterior surface of the member 143 or cap 160, and (c) convected from the exterior surface of the member 143 or cap 160 into the environment surrounding the luminaire 100.

Thus, the ballast 115 is substantially thermally isolated from heat from the HID lamp 110. Thermally isolating the ballast 115 from at least a portion of the heat generated by the HID lamp 110 allows the ballast 115 to be disposed relatively close to the HID lamp 110 without becoming overheated. For example, the ballast 115 may be disposed within only a few inches of the HID lamp 110 in certain exemplary embodiments.

A person of ordinary skill in the art having the benefit of the present disclosure will recognize that the shape and size of the member 135 can vary depending on a variety of factors, including the size and shape of the HID lamp 110, the size and shape of each housing 140, 163, and the intensity of the heat expected to be output by the HID lamp 110. For example, in an HID luminaire 100 that includes a 150 watt HID lamp 110, the member 135 may have a thickness (in a direction along an axis that intersects both the HID lamp 110 and the ballast 115) of about 0.06 inches. While the exemplary embodiment describes the member 135 as being a substantially cylindrical member, other geometric and non-geometric shapes, including, but not limited to, square, rectangular, and oval are contemplated and within the scope and spirit of this disclosure.

As would be recognized by a person of ordinary skill in the art, at least a residual amount of the heat from the lamp 110 may travel through or along the rod 175 to the ballast compartment 125. To minimize this amount of heat, at least a portion of the rod 175 may be sealed with a non-conductive or insulative material, such as silicone, in certain exemplary embodiments. For example, an interior or exterior longitudinal surface of the rod 175 may be sealed with such a non-conductive or insulative material.

Although specific embodiments of the invention have been described above in detail, the description is merely for purposes of illustration. It should be appreciated, therefore, that many aspects of the invention were described above by way of example only and are not intended as required or essential elements of the invention unless explicitly stated otherwise. Various modifications of, and equivalent steps corresponding to, the disclosed aspects of the exemplary embodiments, in addition to those described above, can be made by a person of ordinary skill in the art, having the benefit of this disclosure, without departing from the spirit and scope of the invention defined in the following claims, the scope of which is to be accorded the broadest interpretation so as to encompass such modifications and equivalent structures.

What is claimed is:

1. A luminaire, comprising:

a lamp compartment that houses at least one lamp;

a ballast compartment that houses at least one ballast electrically coupled to the at least one lamp;

a substantially nonconductive member disposed substantially between the lamp compartment and the ballast compartment, separating closest ends of the lamp compartment and ballast compartment; and a substantially hollow member extending through the nonconductive member and the adjacent ends of the lamp compartment and ballast compartment, the substantially hollow member being configured to house at least a portion of at least one electric wire that electrically couples the at least one lamp to the at least one ballast.

2. The luminaire of claim 1, wherein the closest ends of the lamp compartment and the ballast compartment do not contact one another.

3. The luminaire of claim 1, wherein the ballast compartment and lamp compartment are substantially collinear.

4. The luminaire of claim 1, wherein each lamp is an HID lamp.

5. The luminaire of claim 1, wherein the substantially hollow member couples together the lamp compartment and ballast compartment.

6. The luminaire of claim 5, wherein the substantially hollow member alone couples together the lamp compartment and ballast compartment.

7. A luminaire, comprising:

a lamp compartment comprising a first elongated member that houses at least one lamp, the first elongated member comprising a first end and a second end, the first end defining an opening through which light from the at least one lamp is emitted;

a ballast compartment comprising a second elongated member that houses at least one ballast electrically coupled to the at least one lamp, the second elongated member comprising a first end and a second end, the first end of the first elongated member and the second end of the second elongated member defining opposite ends of the luminaire; and a substantially nonconductive member disposed substantially between the lamp compartment and the ballast compartment, the substantially nonconductive member engaging the second end of the first elongated member and the first end of the second elongated member and preventing heat from the lamp from travelling from the first elongated member to the second elongated member.

8. The luminaire of claim 7, further comprising a substantially hollow member that extends through the substantially nonconductive member, the second end of the first elongated member, and the first end of the second elongated member, thereby coupling together the first elongated member, the substantially nonconductive member, and the second elongated member.

9. The luminaire of claim 8, wherein the substantially hollow member houses at least a portion of at least one electric wire, which electrically couples the at least one lamp to the at least one ballast.

10. The luminaire of claim 8, wherein at least a portion of the substantially hollow member is sealed with a non-conductive material.

11. The luminaire of claim 7, wherein a longitudinal axis of the first elongated member is substantially parallel to, or aligned with, a longitudinal axis of the second elongated member.

12. The luminaire of claim 7, wherein the second end of the first elongated member does not contact the first end of the second elongated member.

13. The luminaire of claim 7, wherein each of the first and second elongated members and the substantially nonconductive member has a substantially cylindrical shape, and wherein the first and second elongated members and the substantially nonconductive member have substantially equal diameters.

14. A luminaire, comprising:

a lamp compartment comprising a first elongated member configured to house a lamp, the first elongated member comprising:

a first end defining an opening through which light from the lamp is emitted; and a second end comprising a first removable cap to which a socket is mounted, the socket being configured to receive the lamp;

a ballast compartment comprising a second elongated member that houses a ballast electrically coupled to the lamp, the second elongated member comprising:

a first end and a second end, the first end of the first elongated member and the second end of the second elongated member defining opposite ends of the luminaire, the second end of the second elongated member comprising a second removable cap providing access the ballast;

a substantially nonconductive member disposed substantially between the lamp compartment and the ballast compartment, the substantially nonconductive member engaging the second end of the first elongated member and the first end of the second elongated member and preventing heat from the lamp from travelling from the first elongated member to the second elongated member; and a substantially hollow member extending through the substantially nonconductive member, the second end of the first elongated member, and the first end of the second elongated member, thereby coupling together the first elongated member and the second elongated member, the substantially hollow member housing at least a portion of at least one electric wire electrically coupling the lamp to the ballast.

15. The luminaire of claim 14, wherein the ballast is removably coupled to an interior surface of the ballast compartment via at least one tab and at least one corresponding slot.

16. The luminaire of claim 15, wherein the at least one tab is integral with, or coupled to, the ballast, and the at least one corresponding slot is integral with, or gulped to, the interior surface of the ballast compartment.

17. The luminaire of claim 14, wherein the substantially hollow member alone couples together the lamp compartment and ballast compartment.

18. The luminaire of claim 14, wherein the substantially hollow member comprises a stainless steel all-thread.

19. The luminaire of claim 14, wherein first elongated member and the second elongated member are disposed along a common longitudinal axis.

20. The luminaire of claim 14, wherein each of the first elongated member and the second elongated member comprises a metallic material, and the substantially nonconductive member comprises a plastic material.

* * * * *